US009114452B2

(12) United States Patent
Mangoyan

(10) Patent No.: US 9,114,452 B2
(45) Date of Patent: Aug. 25, 2015

(54) METHOD AND SYSTEM FOR CASTING METAL

(71) Applicant: Ohannes G. Mangoyan, Allison Park, PA (US)

(72) Inventor: Ohannes G. Mangoyan, Allison Park, PA (US)

(73) Assignee: McConway & Torley, LLC, Dallas, TX (US)

( * ) Notice: Subject to any disclaimer, the term of this patent is extended or adjusted under 35 U.S.C. 154(b) by 124 days.

(21) Appl. No.: 14/059,065

(22) Filed: Oct. 21, 2013

(65) Prior Publication Data

US 2015/0107795 A1 Apr. 23, 2015

(51) Int. Cl.
*B22C 9/08* (2006.01)
*B22C 9/00* (2006.01)

(52) U.S. Cl.
CPC . *B22C 9/088* (2013.01); *B22C 9/00* (2013.01); *B22C 9/084* (2013.01)

(58) Field of Classification Search
CPC ..... B22C 9/088
USPC ..... 164/359, 360
See application file for complete search history.

(56) References Cited

U.S. PATENT DOCUMENTS 7,934,536 B2 * 5/2011 Skerdi ..... 164/359
2009/0301684 A1 * 12/2009 Beckmann et al. ..... 164/137

FOREIGN PATENT DOCUMENTS

EP 1 920 859 5/2008 ..... B22C 9/08

OTHER PUBLICATIONS

International Search Report and Written Opinion for PCT/US2014/061051; 8 pages, Jan. 5, 2015.

* cited by examiner

*Primary Examiner* — Kevin E Yoon
(74) *Attorney, Agent, or Firm* — Baker Botts L.L.P.

(57) ABSTRACT

A metal casting riser sleeve system includes a cope mold portion and an outer riser sleeve portion positioned in the cope mold portion. The outer riser sleeve portion encloses a central outer riser sleeve portion passageway between an outer riser sleeve portion bottom end and top end. The system also includes an inner riser sleeve portion that forms a central inner riser sleeve portion passageway between an inner riser sleeve portion bottom end and top end. The inner riser sleeve portion is slidably positioned within the outer riser sleeve portion passageway. The inner riser sleeve portion is operable to slide upward such that the inner riser sleeve portion top end is above the outer riser sleeve portion top end and such that a riser sleeve system passageway is formed between the inner riser sleeve portion top end and the outer riser sleeve portion bottom end.

20 Claims, 5 Drawing Sheets

METHOD AND SYSTEM FOR CASTING METAL

TECHNICAL FIELD

The present disclosure is related to methods and systems for casting metal, and more particularly to methods and systems for casting metal using extensible riser sleeves.

BACKGROUND

Foundries produce metal castings using a sand casting process. The sand casting process is characterized by using sand as a mold material. A frame or mold box known as a flask contains the molding sand. A foundryman creates mold cavities by compacting molding sand around mold patterns within the flask. The metal casting is formed by filling the mold cavities with molten metal. Most metals shrink upon cooling. To prevent the shrinkage from creating voids in the metal casting, a reservoir known as a riser is built into the mold. Risers provide molten metal to the casting as it solidifies so that any voids form in the riser and not the casting.

Foundries are sometimes faced with the situation where the amount of space between a mold cavity and the top of the mold is insufficient to allow for a correctly sized riser. A correctly sized riser contains enough molten material to compensate for any shrinkage in the casting. The height to diameter ratio of the riser varies depending on the molten material, location of the riser within the flask, and the size of the flask. When the space available between the mold cavity and the top of the mold will not accommodate the calculated riser size, foundrymen have traditionally followed the time and labor intensive process of abutting a riser sleeve to the exterior of the flask.

In the traditional process, a foundryman inserts a short section of riser sleeve between the pattern and the top of the mold. After the mold is complete, the foundryman adds an additional riser sleeve to the outside of the flask and abutting the top of the molded riser sleeve. To prevent molten metal from leaking at the abutment, the foundryman packs molding sand around the junction of the external riser sleeve and the molded riser sleeve. After the molding process is complete and before the flask may be reused, the foundryman must clean the flask exterior of any molding sand and any metal that may have leaked through the junction between the molded riser sleeve and the external riser sleeve during casting. Such leakage during casting may also result in a defective casting because of an insufficient volume of molten material available to the mold cavity. Additionally, the molding sand packed around the junction between the external riser sleeve and the molded riser sleeve sometimes migrates through the junction, contaminating the mold cavity.

SUMMARY

The teachings of the present disclosure relate to a system and a method for casting metal using extensible riser sleeve systems such as a telescoping riser sleeve. In accordance with one embodiment, a metal casting system includes a molding flask comprising a drag mold portion comprising external and internal drag mold walls and a cope mold portion comprising external and internal cope mold walls. The internal drag mold walls and internal cope mold walls form, at least in part, a mold pattern cavity representative of a mold pattern. The system also includes a riser sleeve comprising an outer riser sleeve portion positioned in the cope mold portion and enclosing a central outer riser sleeve portion passageway between an outer riser sleeve portion bottom end and top end. The riser sleeve further comprises an inner riser sleeve portion forming a central inner riser sleeve portion passageway between an inner riser sleeve portion bottom end and top end. The inner riser sleeve portion is slidably positioned within the outer riser sleeve portion passageway. The inner riser sleeve portion is operable to slide upward such that the inner riser sleeve portion top end is above the outer riser sleeve portion top end and such that a riser sleeve system passageway is formed between the inner riser sleeve portion top end and the outer riser sleeve portion bottom end. The riser sleeve is configured to allow molten alloy to flow between the mold pattern cavity and the riser sleeve system passageway. In certain embodiments, the inner and outer riser sleeve portions are tapered and the inner riser sleeve portion is operable to telescope upward.

According to another embodiment, a method is provided for casting metal. The method includes positioning a riser sleeve system within a cope mold portion of a molding flask to create a passageway between a cavity representative of a mold pattern and an external cope mold wall. The riser sleeve system comprises an outer riser sleeve portion positioned in the cope mold portion and enclosing a central outer riser sleeve portion passageway between an outer riser sleeve portion bottom end and top end. The riser sleeve further comprises an inner riser sleeve portion forming a central inner riser sleeve portion passageway between an inner riser sleeve portion bottom end and top end. The inner riser sleeve portion is slidably positioned within the outer riser sleeve portion passageway. The inner riser sleeve portion is operable to slide upward such that the inner riser sleeve portion top end is above the outer riser sleeve portion top end and such that a riser sleeve system passageway is formed between the inner riser sleeve portion top end and the outer riser sleeve portion bottom end. The method further includes closing the mold flask and extending the inner riser sleeve portion top end above the external cope mold wall. The method also includes at least partially filling the mold pattern cavity and the riser sleeve system passageway with a molten alloy. In certain embodiments, the inner and outer riser sleeve portions are tapered and the inner riser sleeve portion is operable to telescope upward.

Certain embodiments may provide one or more technical advantages. In some embodiments, the extensible configuration of inner and outer riser sleeve portions provides efficient use of foundry manpower. A traditional method requires foundrymen to add a riser sleeve extension to the top of a molded riser sleeve by abutting the riser sleeve extension to the molded riser and compacting molding sand around the junction. After the casting process, foundrymen must clean the flask exterior of compacted sand and leaked metal. The traditional method is time and labor intensive. An extensible configuration of inner and outer riser sleeve portions obviates the need to compact molding sand around a junction of the molded riser and the riser extension. Another technical advantage of particular embodiments is the avoidance of molten metal leakage commonly occurring at the junction found in the traditional method. Preventing leakage reduces the number of defective castings. A similar advantage is the prevention of contamination of the mold cavity with molding sand commonly occurring at the junction found in the traditional method. Another technical advantage of particular embodiments is that a foundryman can store and transport the flask without risk of damage to an exposed riser sleeve extension because the inner riser sleeve portion need not be extended until time to pour the molten metal in the mold. Another advantage is that the cost of the extensible riser sleeve system may be less than that of the traditional external riser sleeve and molded riser sleeve combination.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of particular embodiments will be apparent from the detailed description taken in conjunction with the accompanying drawings in which.

DETAILED DESCRIPTION

Figure 1:
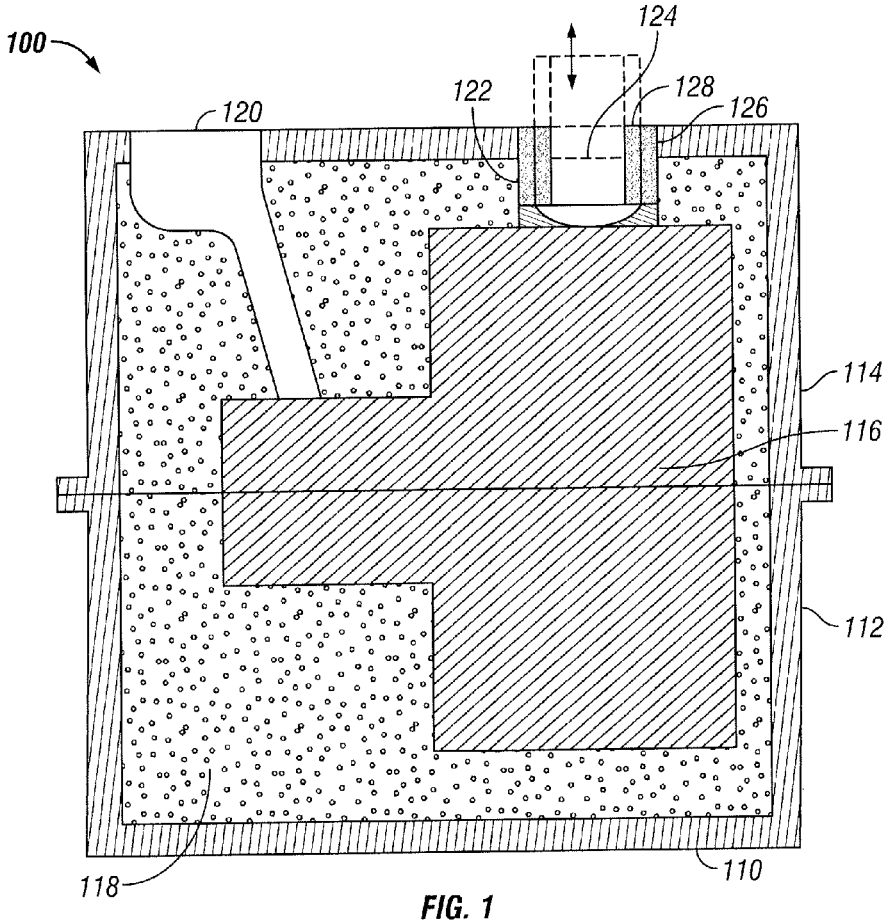
FIG. 1 is a cross-sectional view of a metal casting system with an extensible riser sleeve system, in accordance with particular embodiments.

FIG. 1 is a cross-sectional view of a metal casting system, in accordance with particular embodiments. Metal casting system 100 includes a flask 110 into which a foundryman pours molten metal, such as liquid steel, to form a metal casting. Flask 110 comprises a drag mold portion 112 and a cope mold portion 114. The cope and drag mold portions both comprise molding sand 118 that defines a mold cavity 116. Flask 110 forms a frame around the mold portions. The shape of flask 110 may be square, rectangular, round, or any convenient shape suitable to contain the pattern defining mold cavity 116. Flask 110 may be made of steel, aluminum, wood, or any material suitable for containing molding sand 118 and molten alloy. One of skill in the art would also recognize that flask 110 may comprise more than two mold portions, depending on the complexity of the mold pattern. A foundryman may use a high pressure process and molding pattern to create the internal walls of mold cavity 116. The walls define at least in part the surfaces of the cavity into which a foundryman pours the molten alloy, and where the molten alloy solidifies, during the metal casting process. Molding sand 118 may comprise green sand. Green sand may include a combination of sand, water, and/or clay. Other embodiments may utilize other suitable materials, such as other types of molding sand or plaster, to make up the cope and drag molds. In some embodiments, the sand casting process may include chemically bonded molds, plaster molds, no bake molds, or vacuum process molds.

Metal casting system 100 also includes a sprue 120 and an extensible riser system 122. Sprue 120 is a passageway through which a foundryman introduces molten alloy into mold cavity 116. One end of sprue 120 forms an opening in an external wall of flask 110, and another end connects to mold cavity 116. The cope and drag mold portions support sprue 120. Extensible riser system 122 insulates a riser reservoir 124. Riser reservoir 124 receives molten alloy after it flows through sprue 120 and mold cavity 116. A top end of riser reservoir 124 forms an opening in an external wall of flask 110. A bottom end of riser reservoir 124 connects to mold cavity 116. Extensible riser system 122 comprises an outer riser sleeve portion 126 and an inner riser sleeve portion 128 slidably positioned within outer riser sleeve portion 126. Inner riser sleeve portion 128 is operable to slide upward and beyond the edge of flask 110, thus increasing the internal volume of riser reservoir 124. The dotted lines on FIG. 1 depict inner riser sleeve portion 128 in an extended position.

When implementing particular embodiments of metal casting system 100, a foundryman packs molding sand 118 around various patterns to form mold cavity 116 and sprue 120. The foundryman inserts extensible riser sleeve system 122 between mold cavity 116 and an external wall of flask 110 to create riser reservoir 124. One of skill in the art would recognize that both the positioning and the number of passageways, such as sprues and riser reservoirs, may vary depending on various factors such as the mold pattern and the metal alloy used in a particular metal casting. The foundryman assembles flask 110 by coupling drag mold portion 114 to cope mold portion 116. Before pouring the molten alloy, the foundryman extends inner riser sleeve portion 128 to form properly sized riser reservoir 124. The foundryman then pours molten alloy into sprue 120. The molten alloy flows through sprue 120 where it fills mold cavity 116 and riser reservoir 124. In some embodiments, the foundryman may pour molten alloy directly into riser reservoir 124. As the molten alloy solidifies and shrinks in mold cavity 116, molten alloy flows from riser reservoir 124 back into mold cavity 116 to compensate for the shrinkage.

Particular embodiments may provide for more efficient solutions, for example, when the amount of space between a mold cavity and the top of the mold is insufficient to allow for a correctly sized riser. A foundryman inserts extensible riser sleeve system 122 sized to fit between mold cavity 116 and an external wall of flask 110. After the mold is complete and before the molten metal is poured into the mold cavity, the foundrymen extends inner riser sleeve portion 128 of extensible riser sleeve system 122 to create a properly sized riser reservoir. Because the foundryman is not packing sand around a junction before molding and not cleaning flasks after molding, the molding process is more efficient. Additionally, particular embodiments of the extensible riser system prevent both leakage of molten metal to the riser exterior and contamination of the riser interior.

Figure 2A:
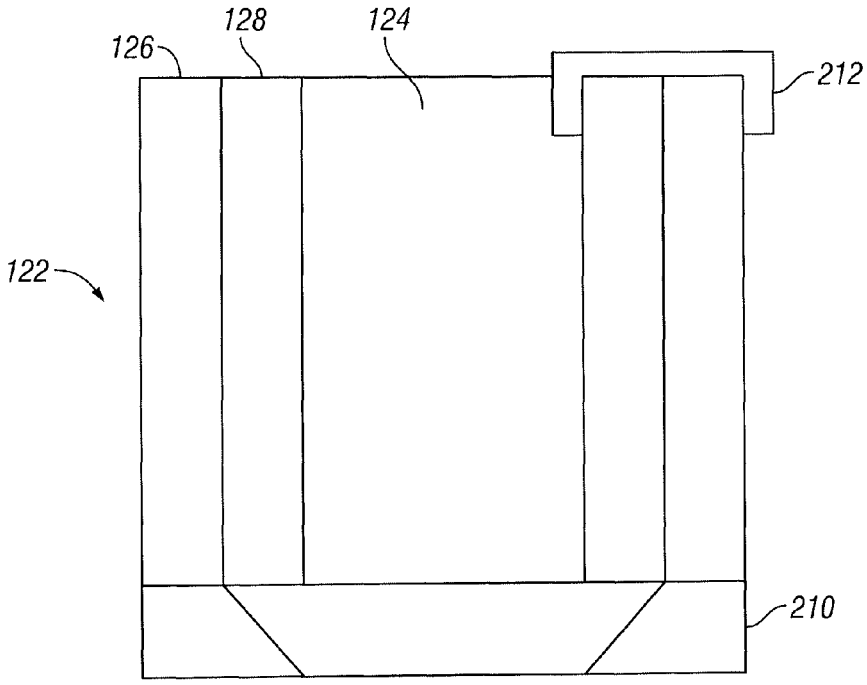
FIGS. 2A and 2B illustrate a cross-sectional and an overhead view, respectively, of an extensible riser sleeve system, in accordance with particular embodiments.
Figure 2B:
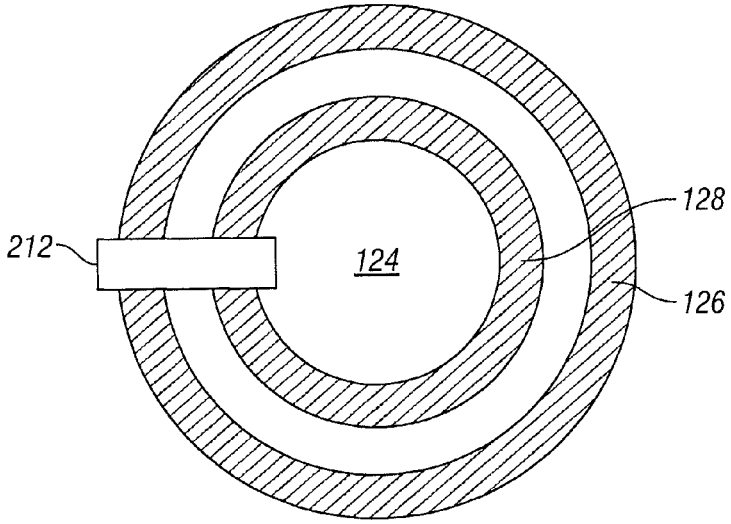

FIGS. 2A and 2B illustrate a cross-sectional and an overhead view, respectively, of an extensible riser sleeve system, in accordance with particular embodiments. Extensible riser sleeve system 122 comprises an outer riser sleeve portion 126 and an inner riser sleeve portion 128. Inner riser sleeve portion 128 is slidably positioned within outer riser sleeve portion 126. Inner riser sleeve portion 128 is operable to slide upward, thus increasing the volume of riser reservoir 124. Breaker core 210 is coupled to outer riser sleeve portion 126 bottom end. Removable fastener 212 couples inner riser sleeve portion 126 to outer riser sleeve portion 128.

Outer and inner riser sleeve portions 126 and 128 may be made from any refractory material (e.g., sand, insulating fiber, exothermic fiber, or a combination of such materials) suitable for containing the metal alloy used in the metal casting process. One of skill in the art would select a suitable material based on the desired insulating or exothermic properties. Outer and inner riser sleeve portions 126 and 128 are sized to prevent the intrusion of molding sand into riser reservoir 124 when inner riser sleeve portion 128 is in the extended position. Outer and inner riser sleeve portions 126 and 128 are also sized to prevent the leakage of molten alloy out of riser reservoir 124 when inner riser sleeve portion 128 is in the extended position. Though inner riser sleeve portion 128 is depicted with an open top end, one of skill in the art would recognize that inner riser sleeve portion 128 top end may be enclosed or partially enclosed to modify its insulating or exothermic properties. The enclosure may be fixed or removable and of various shapes. For example, the top enclosure may be flat or domed. In particular embodiments, outer and inner riser sleeve portions 126 and 128 may form concentric cylinders as depicted in FIG. 2B. In some embodiments, outer and inner riser sleeve portions 126 and 128 may form any shape suitable for forming a riser reservoir where the inner riser sleeve portion is operable to slide upward above the outer riser sleeve portion.

Breaker core 210 is coupled to outer riser sleeve portion 126 bottom end. In particular embodiments, breaker core 210 comprises resin-cured sand, such as a 3-part resin cured sand comprising silica sand made through a phenolic urethane process. A breaker core reduces the diameter of a riser reservoir at the place where it attaches to the mold cavity. In addition to providing this neck down feature at the junction of breaker core 210 and mold cavity 116, breaker core 210 also prevents inner riser sleeve portion 128 from sliding below outer riser sleeve portion 126 bottom end. Thus, breaker core 210 prevents inner rise sleeve portion 128 from sliding into mold cavity 116 when a foundryman couples drag mold portion 112 to cope mold portion 114. Additionally, breaker core 210 prevents separation of inner riser sleeve portion 128 through outer riser sleeve portion 126 bottom end during storage and handling of extensible riser sleeve system 122.

Removable fastener 212 couples inner riser sleeve portion 126 to outer riser sleeve portion 128. Removable fastener 212 may comprise tape, a plastic clip, or any other removable fastener suitable to couple outer and inner riser sleeve portions 126 and 128. The coupling of outer and inner sleeve portions may use multiple removable fasteners 212. Removable fastener 212 prevents inner riser sleeve portion 128 from sliding above outer riser sleeve portion 126 top end. For example, if a foundryman inverts extensible riser sleeve system 122 during handling, inner riser sleeve portion 128 will not separate from outer riser sleeve portion 126. The same benefit is realized if a foundryman inverts flask 110 with extensible riser sleeve system 122 installed. A foundryman removes removable fastener 212 before extending inner riser sleeve portion 128.

Another advantage of an extensible riser sleeve system is that the inner riser sleeve portion may remain in an unextended position until the foundryman is ready to pour the molten alloy. Using the traditional method, once a foundryman molds an external riser to the flask exterior, stacking of the flasks for efficient storage becomes difficult. Similarly, handling of the flask requires caution not to damage the protruding external riser sleeve. Thus, an extensible riser sleeve system provides efficiencies in flask storage and handling.

Figure 3A:
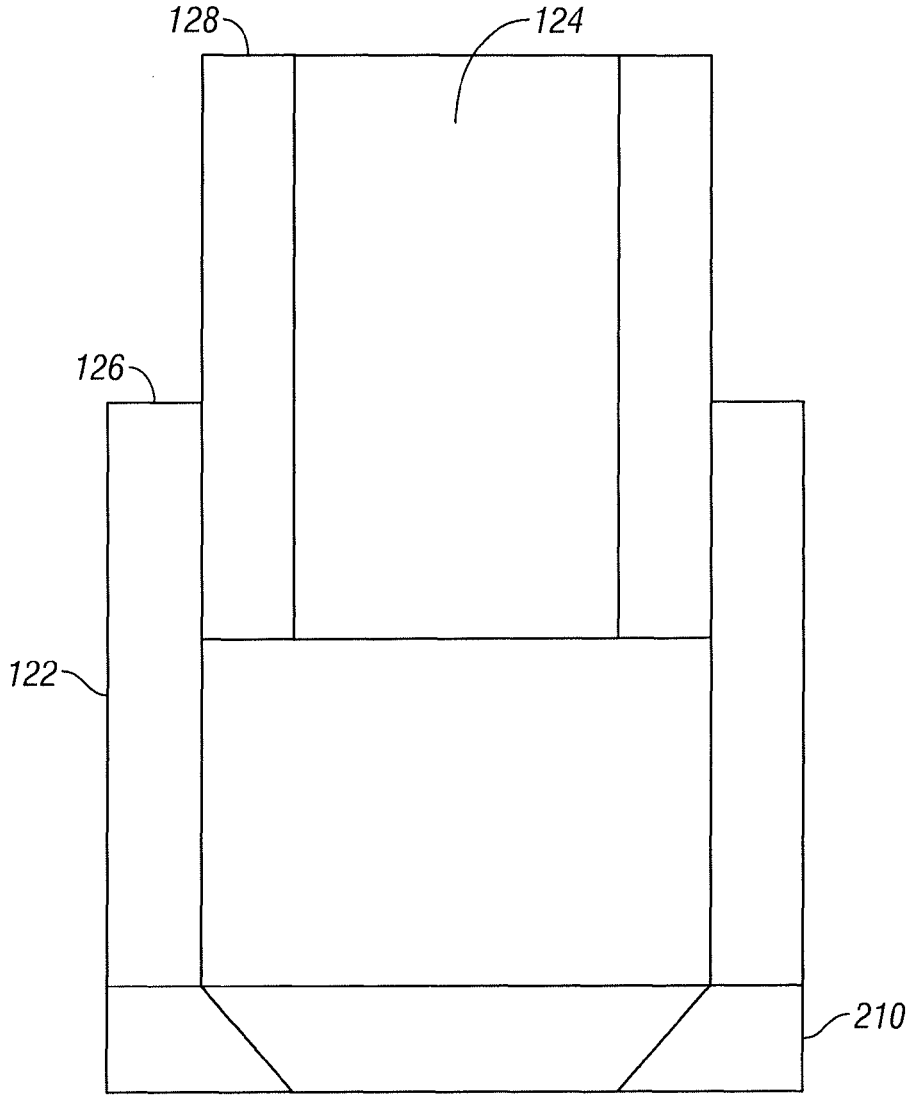
FIG. 3A is another cross-sectional view of an extensible riser sleeve system similar to that of FIG. 2A with an extended inner riser sleeve portion, in accordance with particular embodiments.
Figure 3B:
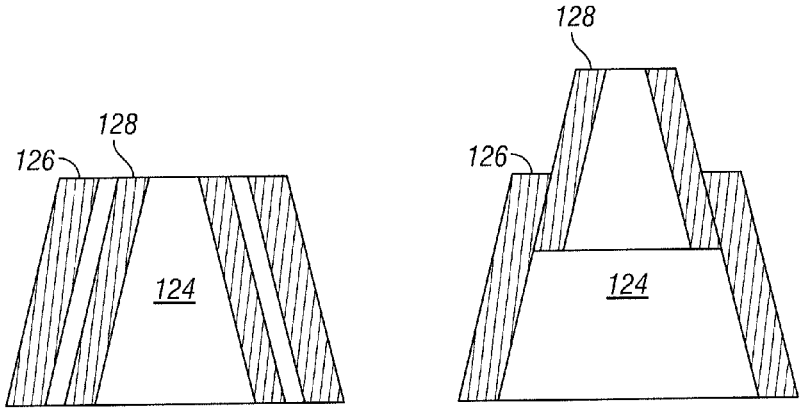
FIG. 3B is a cross-sectional view of an extensible riser sleeve system with telescoping inner and outer riser sleeve portions, in accordance with particular embodiments.
Figure 3C:
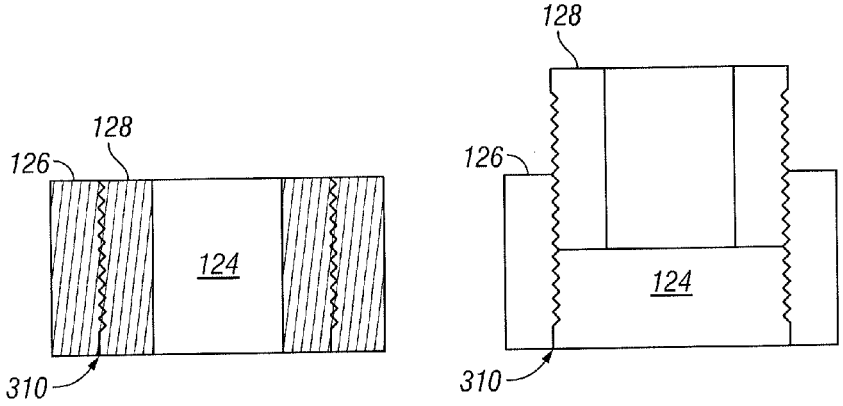
FIG. 3C is a cross-sectional view of an extensible riser sleeve system with threaded inner and outer riser sleeve portions, in accordance with particular embodiments.
Figure 3D:
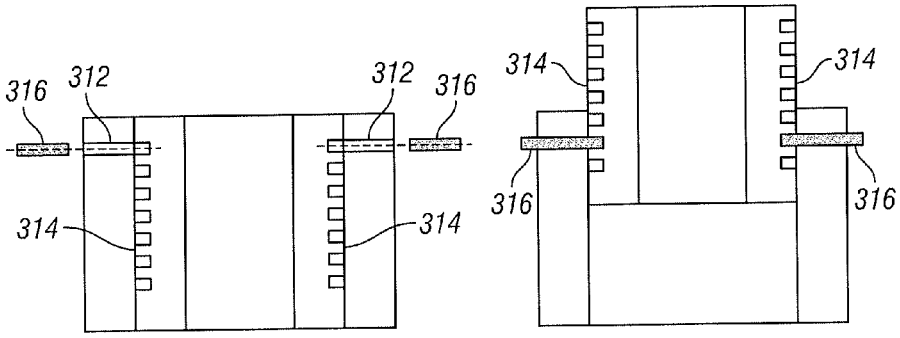
FIG. 3D is a cross-sectional view of an extensible riser sleeve system with slots and pins in the inner and outer riser sleeve portions, in accordance with particular embodiments.

FIG. 3A is another cross-sectional view of an extensible riser sleeve system similar to that of FIG. 2A with an extended inner riser sleeve portion, in accordance with particular embodiments. Inner riser sleeve portion 128 top end is shown extended above outer riser sleeve portion 126 top end. Inner riser sleeve portion 128 bottom end is still sufficiently below outer riser sleeve 126 top end to maintain the lateral stability of extensible riser system 122. Additionally, the overlap between inner riser sleeve portion 128 bottom end and outer riser sleeve 126 top end is sufficient to prevent the intrusion of molding sand into riser reservoir 124 or the leakage of molten alloy from riser reservoir 124. One of ordinary skill in the art would contemplate various mechanisms for maintaining inner riser sleeve portion 128 in an extended position during the metal casting process. FIGS. 3B-D illustrate some examples.

FIG. 3B is a cross-sectional view of an extensible riser sleeve system with telescoping inner and outer riser sleeve portions, in accordance with particular embodiments. Outer and outer inner sleeve portions 126 and 128 form tapered, concentric cylinders. The dimensions of the cylinders and degree of taper are configured to permit inner riser sleeve portion 128 to telescope above outer riser sleeve portion 126. Inner riser sleeve portion 128 maintains its extended position through friction between outer and inner riser sleeve portions 126 and 128. While the illustrated embodiment depicts concentric cylinders, inner and outer riser sleeve portions may comprise any shape suitable for forming a riser reservoir and capable of telescopic movement. An advantage of this configuration is its simplicity of manufacture and operation.

FIG. 3C is a cross-sectional view of an extensible riser sleeve system with threaded inner and outer riser sleeve portions, in accordance with particular embodiments. The interior wall of outer riser sleeve 126 and the exterior wall of inner riser sleeve portion 128 comprise threading 310 that maintains the position of inner riser sleeve portion 128 with respect to outer riser sleeve portion 126. A foundryman varies the position of inner riser sleeve portion 128 by twisting inner riser sleeve portion 128 to raise or lower inner riser sleeve portion 128 with respect to outer riser sleeve portion 126. An advantage of this configuration is that the foundryman has fine control over the position of inner riser sleeve portion 128 in both its extended and unextended positions. For example, the foundryman is able to adjust the unextended position of inner riser sleeve portion 128 so that extensible riser sleeve system 122 fits between the mold cavity and the external wall of the flask for various sizes of mold patterns and flasks. Another advantage is that the threaded coupling allows inner riser sleeve portion 128 to maintain its position even in environments where the extensible riser system is exposed to jostling or vibration. Still another advantage is that inner riser sleeve portion 128 can maintain an unextended position without the use of removable fasteners. In the illustrated embodiment, threading 310 is continuous along a substantial portion of the riser sleeve walls. Other embodiments may only comprise threading along a portion of the riser sleeve walls. In still other embodiments the threading may not be continuous, but instead comprises a system of tabs and slots, enabling a foundryman to perform faster adjustments of the inner riser sleeve portion from unextended to extended positions.

FIG. 3D is a cross-sectional view of an extensible riser sleeve system with slots and pins in the inner and outer riser sleeve portions, in accordance with particular embodiments. Outer riser sleeve portion 126 comprises one or more slots 312 configured to allow pin 316 to pass through outer riser sleeve portion 126 and into partial slots 314 in inner riser sleeve portion 128 configured to receive pin 316. A foundryman varies the position of inner riser sleeve portion 128 by disengaging pin 316 at least from slot 314, raising or lowering the position of inner riser sleeve portion 128, and inserting pin 316 through slot 312 to engage a new partial slot 314, maintaining inner riser sleeve portion 128 in its new position. An advantage of this configuration is that inner riser sleeve portion 128 can maintain an unextended position without the use of removable fasteners.

Figure 4:
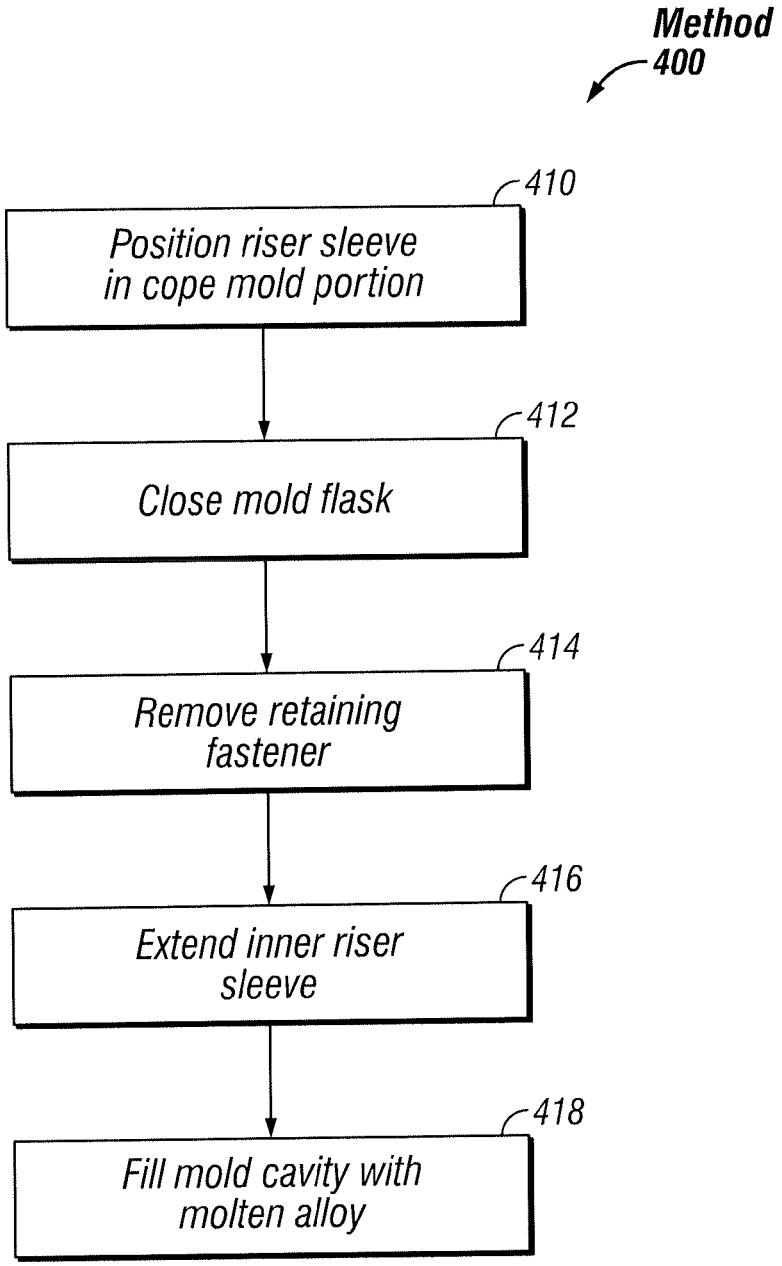
FIG. 4 is flowchart depicting a method for casting metal using an extensible riser sleeve system, in accordance with particular embodiments.

FIG. 4 is a flowchart depicting a method for casting metal using an extensible riser sleeve system, in accordance with particular embodiments. Method 400 begins at step 410 where a foundryman prepares the flask for molding. The foundryman packs molding sand 118 around a mold pattern contained in flask 110. Flask 110 is separable into at least two portions, drag mold portion 112 and cope mold portion 114, to facilitate removal of the mold pattern from molding sand 118. Removal of the mold pattern creates mold cavity 116. In a similar fashion, a foundryman forms sprue 120 by pressing and removing a dowel, or any pattern sufficient to create a passageway connecting the external wall of flask 110 to mold cavity 116, into molding sand 118. The foundryman also forms riser reservoir 124 by inserting extensible riser sleeve system 122 between mold cavity 116 and the external wall of flask 110. The number and the positioning of the sprue(s) and riser reservoir(s) may vary depending on various factors such as the mold pattern and the metal alloy being used.

At step 412 the foundryman couples drag mold portion 112 to cope mold portion 114 to prepare the flask for receiving the molten alloy. At this time, inner riser sleeve portion 128 may be in an unextended position. Inner riser sleeve portion 128 may remain in an unextended position facilitating flask storage or transportation. In some embodiments, the foundryman may attach a removable fastener to retain inner riser sleeve portion 128 in an unextended position.

When the flask is ready to receive the molten alloy, the foundryman removes the removable fastener from outer and inner riser sleeve portions 126 and 128 at step 414. In some embodiments, the foundryman may skip this step because a removable fastener was not present.

At step 416, the foundryman extends inner riser sleeve portion 128 above the external wall of flask 110, forming rise reservoir 124 of a volume appropriately sized for the particular mold pattern.

At step 418, the foundryman pours molten alloy into sprue 120. The molten alloy flows through sprue 120 where it fills mold cavity 116 and riser reservoir 124. In some embodiments, the foundryman may pour molten alloy directly into riser reservoir 124. As the molten alloy solidifies and shrinks in mold cavity 116, molten alloy flows from riser reservoir 124 back into mold cavity 116 to compensate for the shrinkage. The method is complete when the molten alloy has solidified. A foundryman may prepare flask 110 for reuse without having to clean molding sand or leaked metal from the exterior wall of flask 110.

Modifications, additions, or omissions may be made to the method described herein without departing from the scope of the present disclosure. For example, the steps may be combined, modified, or deleted where appropriate, and additional steps may be added. Additionally, the steps may be performed in any suitable order.

Although embodiments of the present disclosure and their advantages have been described in detail, it should be understood that various other changes, substitutions, and alterations may be made hereto without departing from the spirit and scope of the invention as defined by the claims below. For example, although particular embodiments of the disclosure have been described with reference to an extensible riser sleeve system, the elements disclosed may apply to other casting components that require more height than is available within the flask. As another example, although particular steps have been described as being performed by a foundryman (e.g., pouring molten alloy, extending riser sleeves, etc.) many of those steps may also be machine automated.

What is claimed is:

1. A metal casting riser sleeve system, comprising:
a cope mold portion;
an outer riser sleeve portion positioned in the cope mold portion and enclosing a central outer riser sleeve portion passageway between an outer riser sleeve portion bottom end and top end;
an inner riser sleeve portion forming a central inner riser sleeve portion passageway between an inner riser sleeve portion bottom end and top end, the inner riser sleeve portion slidably positioned within the outer riser sleeve portion passageway; and
the inner riser sleeve portion operable to slide upward such that the inner riser sleeve portion top end is above the outer riser sleeve portion top end and such that a riser sleeve system passageway is formed between the inner riser sleeve portion top end and the outer riser sleeve portion bottom end.

2. The system of claim 1, further comprising a removable fastener coupling the inner riser sleeve portion to the outer riser sleeve portion, the removable fastener configured to prevent the inner riser sleeve portion from extending beyond the outer riser sleeve portion top end.

3. The system of claim 1, further comprising a breaker core coupled to the outer riser sleeve portion bottom end, the breaker core configured to prevent the inner riser sleeve portion bottom end from extending below the outer riser sleeve portion bottom end.

4. The system of claim 1, wherein:
the inner and outer riser sleeve portions are tapered; and
the inner riser sleeve portion is operable to telescope upward.

5. The system of claim 1, further comprising a fastener configured to maintain the inner riser sleeve portion in an extended position above the outer riser sleeve portion top end.

6. The system of claim 1, wherein the inner riser sleeve portion and the outer riser sleeve portion are configured such that friction between an exterior wall of the inner riser sleeve portion and an interior wall of the outer riser sleeve portion maintains the inner riser sleeve portion in an extended position above the outer riser sleeve portion top end.

7. The system of claim 1, wherein an exterior wall of the inner riser sleeve portion and an interior wall of the outer riser sleeve portion comprise threading that maintains the inner riser sleeve portion in an extended position above the outer riser sleeve portion top end.

8. The system of claim 1, wherein:
an exterior wall of the inner riser sleeve portion comprises an inner portion slot oriented substantially perpendicular to the exterior wall of the inner riser sleeve portion;
the outer riser sleeve portion comprises an outer portion slot oriented substantially perpendicular to an exterior wall of the outer riser sleeve portion and extending from the exterior wall of the outer riser sleeve portion to an interior wall of the outer riser sleeve portion; and
the outer portion slot is configured to slidably receive a pin that engages the inner portion slot to maintain the inner rise sleeve portion in an extended position above the outer riser sleeve portion top end.

9. A metal casting system, comprising:
a molding flask comprising:
a drag mold portion comprising external and internal drag mold walls;

a cope mold portion comprising external and internal cope mold walls; and wherein, the internal drag mold walls and internal cope mold walls form at least in part a mold pattern cavity representative of a mold pattern; and a riser sleeve comprising:

an outer riser sleeve portion positioned in the cope mold portion and enclosing a central outer riser sleeve portion passageway between an outer riser sleeve portion bottom end and top end;

an inner riser sleeve portion forming a central inner riser sleeve portion passageway between an inner riser sleeve portion bottom end and top end, the inner riser sleeve portion slidably positioned within the outer riser sleeve portion passageway; and the inner riser sleeve portion operable to slide upward such that the inner riser sleeve portion top end is above the outer riser sleeve portion top end and such that a riser sleeve system passageway is formed between the inner riser sleeve portion top end and the outer riser sleeve portion bottom end; and wherein, the riser sleeve is configured to allow molten alloy to flow between the mold pattern cavity and the riser sleeve system passageway.

10. The system of claim 9, further comprising a removable fastener coupling the inner riser sleeve portion to the outer riser sleeve portion, the removable fastener configured to prevent the inner riser sleeve portion from extending beyond the external cope mold wall.

11. The system of claim 9, further comprising a breaker core coupled to the outer riser sleeve portion bottom end, the breaker core configured to prevent the inner riser sleeve portion from extending beyond the outer riser sleeve portion bottom end.

12. The system of claim 9, wherein:

the inner and outer riser sleeve portions are tapered; and the inner riser sleeve portion is operable to telescope upward.

13. The system of claim 9, further comprising a fastener configured to maintain the inner riser sleeve portion in an extended position above the outer riser sleeve portion top end.

14. The system of claim 9, wherein the inner riser sleeve portion and the outer riser sleeve portion are configured such that friction between an exterior wall of the inner riser sleeve portion and an interior wall of the outer riser sleeve portion maintains the inner riser sleeve portion in an extended position above the outer riser sleeve portion top end.

15. The system of claim 9, wherein an exterior wall of the inner riser sleeve portion and an interior wall of the outer riser sleeve portion comprise threading that maintains the inner riser sleeve portion in an extended position above the outer riser sleeve portion top end.

16. A metal casting method, comprising:

positioning a riser sleeve system within a cope mold portion of a molding flask to create a passageway between a cavity representative of a mold pattern and an external cope mold wall, the riser sleeve system comprising:

an outer riser sleeve portion positioned in the cope mold portion and enclosing a central outer riser sleeve portion passageway between an outer riser sleeve portion bottom end and top end;

an inner riser sleeve portion forming a central inner riser sleeve portion passageway between an inner riser sleeve portion bottom end and top end, the inner riser sleeve portion slidably positioned within the outer riser sleeve portion passageway; and the inner riser sleeve portion operable to slide upward such that the inner riser sleeve portion top end is above the outer riser sleeve portion top end and such that a riser sleeve system passageway is formed between the inner riser sleeve portion top end and the outer riser sleeve portion bottom end;

closing the mold flask;

extending the inner riser sleeve portion top end above the external cope mold wall; and at least partially filling the mold pattern cavity and the riser sleeve system passageway with a molten alloy.

17. The metal casting method of claim 16, further comprising coupling a removable fastener to the inner rise sleeve portion and the outer riser sleeve portion to couple the inner riser sleeve portion to the outer riser sleeve portion, the removable fastener configured to prevent the inner riser sleeve portion from extending beyond the external cope mold wall.

18. The metal casting method of claim 17, further comprising removing the removable fastener before extending the inner riser sleeve portion beyond the external cope mold wall.

19. The metal casting method of claim 16, further comprising coupling a breaker core to the outer riser sleeve portion bottom end, the breaker core configured to prevent the inner riser sleeve portion from extending beyond the outer riser sleeve portion bottom end.

20. The metal casting method of claim 16, further comprising coupling a fastener to the inner riser sleeve portion and the outer riser sleeve portion to maintain the inner riser sleeve portion in an extended position above the outer riser sleeve portion top end.

* * * * *